US005083530A

United States Patent [19]

Rassey

[11] Patent Number: 5,083,530

[45] Date of Patent: Jan. 28, 1992

[54] INTERNAL COMBUSTION ENGINE HAVING OPPOSED PISTONS

[76] Inventor: Louis J. Rassey, 29048 Gloede, Warren, Mich. 48093

[21] Appl. No.: 582,686

[22] Filed: Sep. 14, 1990

[51] Int. Cl.[5] ..... F02B 75/28
[52] U.S. Cl. ..... 123/51 R; 123/279
[58] Field of Search ..... 123/51 R, 51 A, 51 AA, 123/51 B, 51 BA, 279

[56] References Cited

U.S. PATENT DOCUMENTS 1,126,713 2/1915 Crew .
2,396,429 3/1946 Krygsman ..... 123/51 B
4,244,338 1/1981 Rassey ..... 123/51 AA

FOREIGN PATENT DOCUMENTS 1139870 2/1985 U.S.S.R. ..... 123/51 A

*Primary Examiner*—David A. Okonsky
*Attorney, Agent, or Firm*—Gifford, Groh, Sprinkle, Patmore and Anderson

[57] ABSTRACT

An opposed piston engine includes at least one pair of pistons synchronously reciprocatingly mounted in a hollow cylinder. At least one projection is formed on the face of one piston, while a corresponding recess is formed on the face of the other piston, the recess being dimensioned to at least partly and preferably substantially receive the projection in the recess, upon reciprocation of the pistons. The piston construction is particularly advantageous in opposed cylinder diesel engines, and can eliminate the need for a glow plug to initiate combustion in even a cold engine.

16 Claims, 2 Drawing Sheets

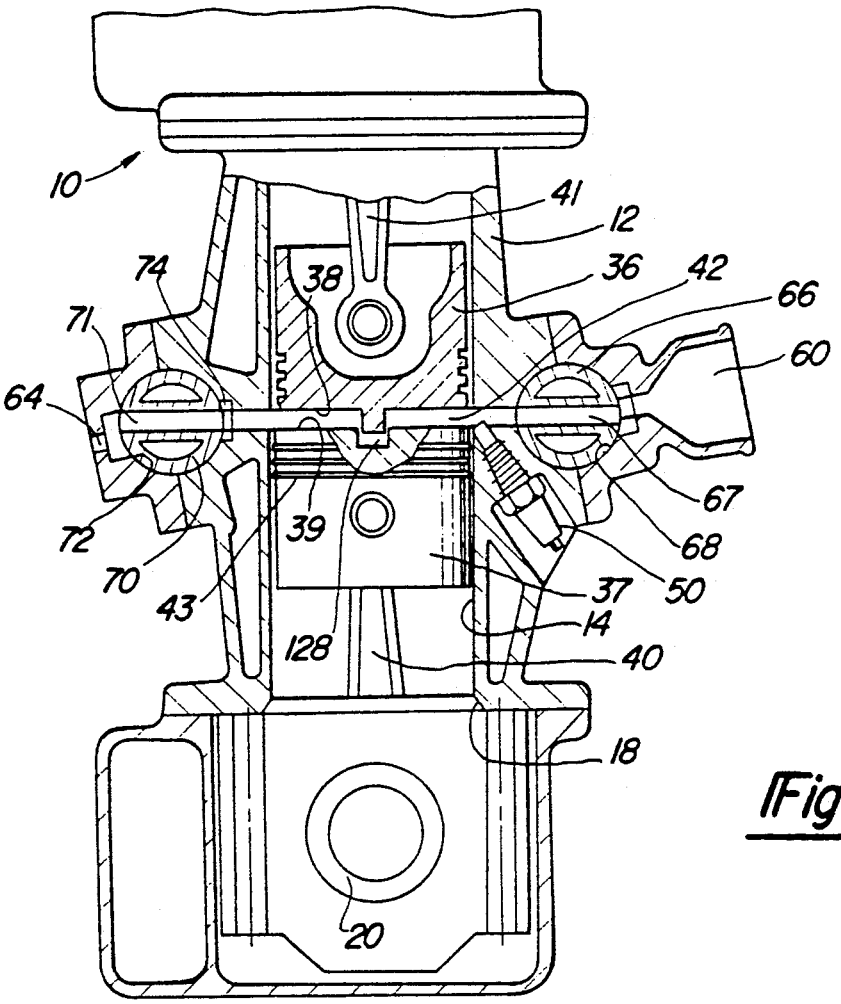
Fig-2
Fig-3
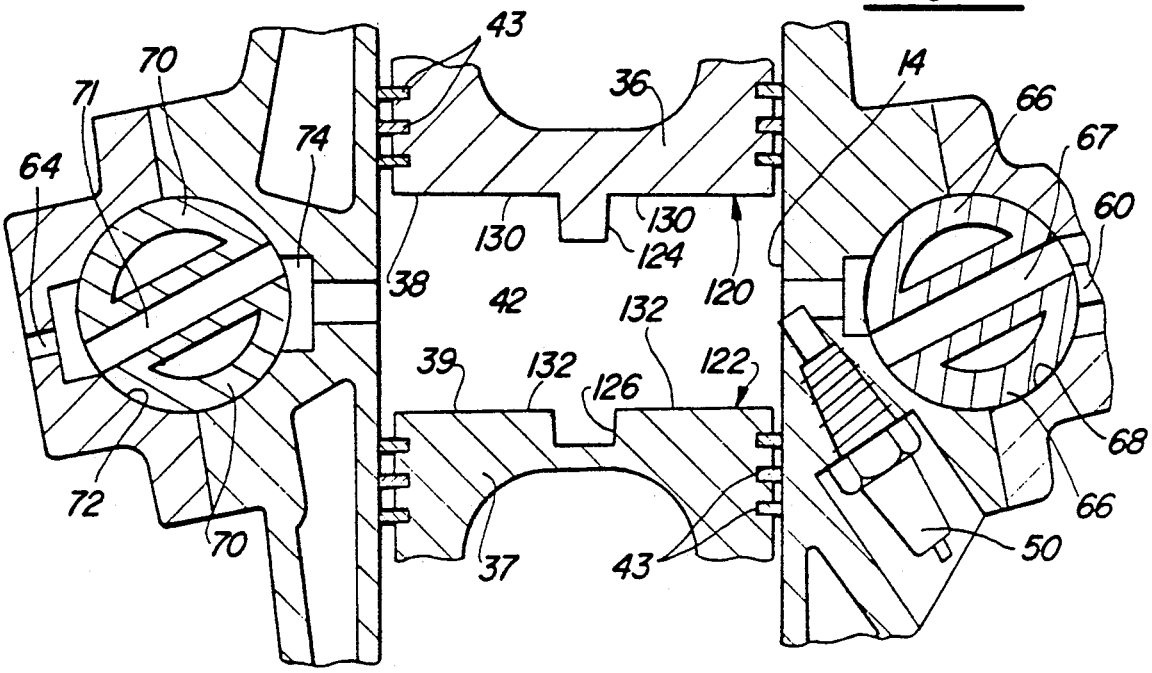

INTERNAL COMBUSTION ENGINE HAVING OPPOSED PISTONS

BACKGROUND OF THE INVENTION

I. Field of the Invention

The present invention relates generally to an opposed piston internal combustion four-cycle engine, and more particularly to the piston construction of such an engine.

II. Description of the Prior Art

There have been a number of previously known opposed piston internal combustion engines, mainly for two-cycle operation. In an opposed piston engine, a pair of piston members are slidably disposed in a facing relationship within a single engine cylinder, so that a combustion chamber is defined between the heads of the piston members. The piston members reciprocate away from and towards each other in synchronism, and in doing so provide the driving output of the engine. The heads of the piston members in such prior opposed piston engines have been substantially flat.

Prior to my U.S. Pat. Nos. 4,198,946 and 4,244,338, opposed piston engines were subject to several drawbacks which did not allow them to enjoy widespread commercial success. For example, the prior opposed piston four-cycle engines presented particular difficulties with the valving of both inducting the fuel-air mixture into the combustion chamber, and exhausting the combustion products from the engine cylinder. Previous attempts to adapt poppet valves proved largely unsuccessful, since the poppet valves could not be positioned above the piston head, as in more conventional internal combustion engines. These problems were particularly acute with opposed piston diesel engines. Prior to the inventions disclosed in these patents, the clearance space between the piston heads at maximum compression was too small to enable the use of poppet valves, so that opposed piston diesel engines were previously thought not possible. The inventions disclosed in those patents overcame these drawbacks and provided an opposed piston diesel engine including synchronized opposed pistons, and rotary valves positioned within the intake and exhaust passageways in communication with the combustion chamber, selectively opening and closing the respective passageways in synchrony with the piston cycle.

While my prior patents successfully provided a generally satisfactory opposed piston diesel engine, that engine still encountered some of the drawbacks of conventional diesel engines. A glow plug or other ignition means was still required to successfully initiate ignition of the fuel-air mixture when the engine was cold. Also, for optimal horsepower output from the engine, it was necessary to balance the compression ratio of the engine against the diameters of the pistons, since proportionately more heat is required to induce combustion as the diameter of the pistons increases. Prior attempts to cure this problem in conventional diesel engines have included means for swirling the fuel-air mixture chamber, but these have increased the complexity of the engine, and the associated costs of manufacturing the pistons. Particularly, when the engine is cold, prior glow plugs have been required to operate for a disadvantageously long time, prior to sustained diesel ignition.

SUMMARY OF THE PRESENT INVENTION

The present invention overcomes these and other disadvantages by providing a piston structure which permits the initiation of diesel ignition in only a small portion of the combustion chamber, so as to readily achieve ignition throughout the combustion chamber in a cold engine, while possibly permitting elimination of the glow plug entirely. In brief, the piston structure according to the present invention comprises the combination of a hollow cylinder containing a pair of opposed pistons synchronously reciprocatingly mounted therein, one of the pistons having a projection facing the other piston, and the other piston having a recess dimensioned to at least partly receive the projection therein upon reciprocation of the pistons in the cylinder. A combustion subchamber is thus formed between the projection and the recess upon reciprocation of the pistons, the subchamber having a smaller volume than the combustion chamber itself, such that diesel ignition of the air-fuel mixture contained in the subchamber is more rapid and more readily achieved than combustion in the combustion chamber itself.

The present invention also includes an opposed piston engine construction comprising the aforementioned piston construction. Preferably, except for this piston construction, the engine is otherwise constructed in accordance with my U.S. Pat. Nos. 4,198,946 and/or 4,244,338, the disclosures of which being incorporated by reference herein.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 2 is an axial plan view of the preferred embodiment of the present invention, with parts removed for clarity; and FIG. 3 is a fragmentary sectional view of the preferred embodiment of the present invention.

DETAILED DESCRIPTION OF THE PREFERRED EMBODIMENT OF THE PRESENT INVENTION

Figure 1:
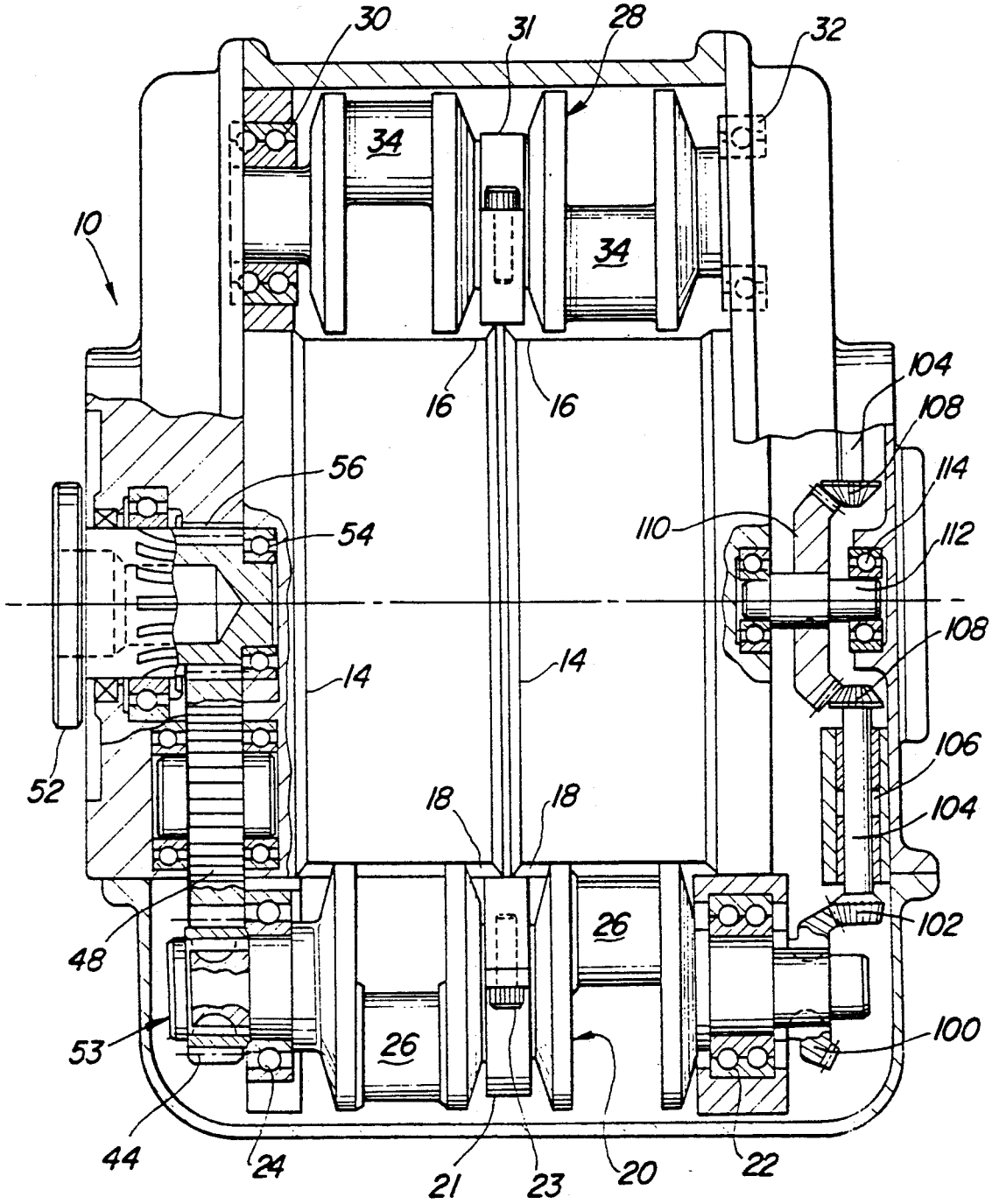
FIG. 1 is a fragmentary plan view of the preferred embodiment of the present invention, with parts removed for clarity.

With reference first to FIGS. 1 and 2, an internal combustion engine 10 incorporating the piston construction according to the present invention is thereshown, first comprising a housing or cylinder block 12 having two engine cylinders 14 formed therethrough in a side-by-side parallel relationship Both of the upper end 16 and the lower end 18 of each cylinder 14 are open in the housing 12.

A first crankshaft 20 is rotatably mounted by a pair of end bearings 22 and 24 and a central bearing 21 to the housing 12, so that the crankshaft 20 rotates upon an axis perpendicular to but coplanar with the longitudinal axes of the cylinders 14. The central bearing 21 is preferably a plain bearing of the type commonly employed in internal combustion engines and is secured to the housing 12 by a plurality of bolts 23. The crankshaft 20 includes two crankpins 26, one each in line with each of the cylinders 14, spaced apart 180 degrees from each other. A second crankshaft 28 is similarly rotatably mounted by a pair of end bearings 30 and 32 and a center plain bearing 31 to the housing 12 adjacent the other axial end 16 of the cylinders 14. The second crankshaft 28 likewise includes a pair of throws or crankpins 34, spaced 180 degrees from each other. The crankshaft 28 rotates about an axis perpendicular to but coplanar with the longitudinal axes of the cylinders 14.

As most clearly shown in FIG. 2, a first piston member 36 and a second piston member 37 are reciprocably slidably disposed in each of the cylinders 14. Each piston 36 or 37 includes a head 38 or 39, respectively, at its innermost axial end, and a piston connecting rod 40 or 41, respectively, extending axially outwardly through the respective open end 16 or 18 of the cylinder 14. The piston connecting rods 40 and 41 are connected in any conventional fashion to the respective crankpins 26 and 34 on the crankshafts 20 and 28. A pair of combustion chambers 42 are thereby formed one each between the heads 38 of each of the first pistons 36 and the heads 39 of each the second pistons 37. Reciprocation of the pistons 36 and 37 away from and towards each other within the cylinders 14 thus rotatably drives the crankshafts 20 and 28.

With reference again to FIG. 1, the crankshaft 20 includes a pinion 44 secured at its rear end 53. The crankshaft pinion 44 meshes with and rotatably drives an idler gear 48. The idler gear 48 in turn rotatably drives a stub output shaft 52 rotatably mounted by bearings 54 to the housing 12. The shaft 52 includes a plurality of external gear teeth 56. The crankshaft 28 includes a similar pinion (not shown) meshing with and rotatably driving a pair of idler gears (also not shown), which in turn rotatably drive the shaft 52 through the gear teeth 56. This gearing thereby serves as a means for synchronizing rotation of the crankshaft in opposite rotational directions.

With reference now to FIGS. 2 and 3, the engine 10 includes an intake passageway 60 for supplying fuel and/or a fuel-air mixture to each of the combustion chambers 42 and similarly includes an exhaust passageway 64 for exhausting the combustion products from each of the combustion chambers 42 exteriorly of the engine 10.

An intake rotary valve 66, which is elongated and cylindrical in shape, is rotatably mounted within a bore 68 in the housing 12, so that the rotary valve 66 is located within the intake passageway 60 and adjacent each of the combustion chambers 42. Similarly, an exhaust rotary valve 70 is rotatably mounted within a bore 72 in the housing 12 within the exhaust passageway 64 and adjacent each of the combustion chambers 42. The valves 66 and 70 are rotatable about an axis parallel with the crankshaft axis and are preferably on diametrically opposed sides of the cylinders 14. In addition, each of the rotary valves 66 and 70 includes a plurality of diametric through bores 67 and 71, respectively, which selectively open and close the intake and exhaust passageways 60 and 64 associated with each of the combustion chambers 42, in dependence upon the rotational position of the rotary valves 66 and 70. The rotary valves 66 and 70 can be of solid or tubular construction and preferably include suitable seals 74 to prevent gas leakage along the valves 66 and 70.

With reference now to FIG. 1, a bevel gear 100 is thereshown secured to the front end of the crankshaft 20. The bevel gear 100 meshes with a cooperating bevel gear 102 secured at one end of a shaft 104 rotatably mounted by bearings 106 to the housing 12 and extending in a direction parallel to the cylinders 14. Another bevel gear 108 is secured to the end of the shaft 104 opposite the gear 102, which meshes with and rotatably drives a bevel gear 110 secured to a stub shaft 112 rotatably mounted by bearings 114 to the front of the engine housing 12. The stud 112 is disposed generally coaxial with the output shaft 52. The crankshaft 28 is similarly connected to the bevel gear 110, and also serves to drive the bevel gear 110 by a similar shaft 104 and bevel gear 108. The intake rotary valve 66 and exhaust rotary valve 70 are driven by gearing (not shown) driven by rotation of the bevel gear 110.

To synchronize rotation of the valves 66 and 70 with rotation of the crankshafts 20 and 28, since the exhaust and intake passageways 64 and 60 are open only once during each two revolutions of the crankshafts 20 and 28, and further since each valve 66 and 70 opens its respective passageways at two rotational positions, the valves 66 and 70 are rotatably driven at a speed equal to one-fourth the rotational speed of the crankshafts 20 and 28.

Again with reference to FIGS. 2 and 3, at least one projection 124 is formed on a first face portion 120 of each of the first pistons 36. The projection 124 preferably comprises an elongate member extending diametrically across the first piston face 120, having a rectangular and preferably square cross section. Preferably, one projection 124 is employed for each pair of pistons 36 and 37, and is centrally or diametrically located on each of the first piston faces 120. A recess 126 is formed on a face portion 122 of each of the second pistons 37, the face portions 120 and 122 facing one another. Each of the recesses 126 is dimensioned to receive at least part and preferably a substantial portion of each of the projections 124 on the first face portions 120 of the first pistons 36. Plainly, when more than one projection 124 is employed on each piston 36, a corresponding number of recesses 126 are required. In any event, the reciprocation of the pistons 36 and 37 towards each other result in the partial introduction of the projections 124 into the associated recesses 126, thereby forming a precombustion subchamber 128 therebetween. The face portions 120 and 122 of each of the first and second pistons 36 and 37 also include second planar face portions 130 and 132, respectively, at those locations on the piston faces 120 and 122 where no projection or recesses are formed.

Operation of the piston construction according to the present invention can now be readily understood. As in any conventional four-cycle diesel engine, movement of the pistons away from the intake passageway (here, movement of both pistons 36 and 37 away from each of the intake passageways 60) draws fuel or a fuel-air mixture into the combustion chambers 42. Movement of the pistons 36 and 37 towards each other compresses the fuel or fuel-air mixture sufficiently to ignite it. The expanding combustion gases from such ignition force the pistons 36 and 37 away from each other. Movement of the pistons 36 and 37 towards each other then exhausts the combustion gases from the combustion chamber 42. The valves 66 and 70 open in coordination with the movement of the pistons 36 and 37 via the previously disclosed gearing affixed to the front end of the crankshafts 20 and 28.

More particularly, during each stroke, the projections 124 on the first face portions 120 of the first pistons 36 are at least partly received in the associated recesses 126 formed in the first face portions 122 of the second pistons 37. Combustion of the fuel or air-fuel mixture in the combustion chamber 42 is initiated in the combustion subchambers 128 formed between the projections 124 and the associated recesses 126. The compression in the subchambers 128 can be greater than that achieved in the chambers 42. The combustion occurring in the subchamber 128 may be sufficient to initiate combustion in the diesel engine even when cold, thereby obviating the need for energizing of the glow plug 50 during start-up.

The piston structure of the present invention is, of course, useful in any opposed piston engine, to augment combustion in the engine cylinders. Thus, the piston construction can be employed in both gasoline and diesel engines. Although described as useful in conjunction with the opposed piston diesel engine shown in my U.S. Pat. Nos. 4,198,946 and 4,244,338, no unnecessary limitation from those particular embodiments should be implied in the present invention.

Having described my invention, however, many modifications thereto will become apparent to those skilled in the art to which it pertains, without deviation from the spirit of the present invention, as defined by the scope of the appended claims.

I claim:

1. A piston structure comprising:

a hollow cylinder;

a first piston and a second piston synchronously reciprocatingly mounted in said cylinder, each of said pistons having an associated face disposed towards the other, said cylinder and said first and second piston faces defining therebetween a combustion chamber;

at least one projection on said face of said first piston extending into said chamber towards said face of said second piston;

at least one recess on said face of said second piston dimensioned to at least partly receive therein said projection on said face of said first piston, upon reciprocation of said pistons in said cylinder; and wherein said at least one projection substantially fills said at least one recess so as to form a pre-combustion subchamber therebetween having a pressure greater than the pressure in said combustion chamber external to said pre-combustion subchamber.

2. The invention according to claim 1, further comprising a glow plug exposed to said combustion chamber.

3. The invention according to claim 1, wherein said at least one projection comprises an elongate member extending across said face of said first piston.

4. The invention according to claim 3, wherein said elongate member possesses a rectangular cross section.

5. The invention according to claim 4, wherein said cross section is substantially square.

6. The invention according to claim 1, wherein said faces of said first and second pistons each include flat and substantially parallel face portions.

7. The invention according to claim 1, wherein said at least one projection is centrally located on said face of said first piston.

8. The invention according to claim 1, wherein said first piston defines an axis, and said at least one projection is centered on said axis.

9. An opposed piston engine comprising:

at least one hollow cylinder;

a first piston and a second piston reciprocatingly mounted in said cylinder, each of said pistons having an associated face disposed towards the other, and said cylinder and said first and second faces defining therebetween a combustion chamber;

means for synchronizing reciprocation of said first and second pistons in said cylinder;

at least one projection on said face of said first piston extending into said combustion chamber towards said face of said second piston;

at least one recess on said face of said second piston dimensioned to at least partly receive therein said projection on said face of said first piston, upon reciprocation of said pistons in said cylinder; and wherein said projection substantially fills said recess so as to form a pre-combustion subchamber therebetween having a pressure greater than said combustion chamber between said first and second pistons.

10. The invention according to claim 9, further comprising a glow plug exposed to said combustion chamber.

11. The invention according to claim 9, wherein said at least one projection comprises an elongate member extending across said face of said first piston.

12. The invention according to claim 11, wherein said elongate member possesses a rectangular cross section.

13. The invention according to claim 12, wherein said cross section is substantially square.

14. The invention according to claim 9, wherein said faces of said first and second pistons each include flat and substantially parallel face portions.

15. The invention according to claim 9, wherein said at least one projection is centrally located on said face of said first piston.

16. The invention according to claim 9, wherein said first piston defines an axis, and said at least one projection is centered on said axis.

* * * * *